United States Patent [19]

Fukase et al.

[11] B 3,998,678

[45] Dec. 21, 1976

[54] METHOD OF MANUFACTURING THIN-FILM FIELD-EMISSION ELECTRON SOURCE

[75] Inventors: Shigeo Fukase, Uenohara; Ushio Kawabe, Hamura, both of Japan

[73] Assignee: Hitachi, Ltd., Japan

[22] Filed: Mar. 20, 1974

[21] Appl. No.: 453,031

[44] Published under the second Trial Voluntary Protest Program on March 16, 1976 as document No. B 453,031.

[30] Foreign Application Priority Data

Mar. 22, 1973 Japan ..... 48-31759

[52] U.S. Cl. ..... 156/3; 156/11; 156/24; 313/309; 313/336; 427/77; 427/259; 427/264; 427/266

[51] Int. Cl.[2] ..... C23F 1/04; A47B 88/00

[58] Field of Search ..... 156/7, 8, 17, 24, 11, 156/3, 13; 29/580; 357/56; 427/77, 78, 259, 266, 269, 270, 271, 272, 282, 287, 264; 313/309, 336

[56] References Cited

UNITED STATES PATENTS

| | | | |
|---|---|---|---|
| 3,475,664 | 10/1969 | De Vries | 156/17 |
| 3,506,506 | 4/1970 | Pennebaker, Jr. | 156/17 |
| 3,531,857 | 10/1970 | Iwamatsu | 29/583 |
| 3,665,241 | 5/1972 | Spindt et al. | 313/309 |
| 3,700,510 | 10/1972 | Keene et al. | 156/17 |
| 3,755,704 | 8/1973 | Spindt et al. | 313/309 |

OTHER PUBLICATIONS

IBM Tech. Discl. Bulletin, "Fabricating Monolithic Circuits," J. Gardiner et al., vol. 10, No. 5, Oct. 1967, pp. 655–656.

*Primary Examiner*—William A. Powell
*Assistant Examiner*—Brian J. Leitten
*Attorney, Agent, or Firm*—Craig & Antonelli

[57] ABSTRACT

A method of manufacturing a thin-film field-emission electron source which is of a sandwich structure of a substrate - metallic film-insulating film - metallic film and which has at least one minute cavity and a field-emitter of, for example, a conical shape within the cavity, comprises the steps of (i) forming on a substrate a first layer of metallic film pattern for current supply, (ii) depositing a second layer film made of an electron emissive material onto the entire area of the substrate provided with the first layer, and thereafter subjecting the second layer film to a mesa etch by a photoetching process, to form a conical emitter on the first layer film, (iii) forming a third layer made of an insulating material, the third layer having a height substantially equal to the level of a tip portion of the emitter, (iv) forming a fourth layer of metallic film pattern as an accelerating electrode, and (v) etching the third layer, so as to expose the extremity of the emitter.

According to the manufacturing method, a thin-film field-emission electron source can be readily produced merely by the combination between the standard evaporation techniques and etching techniques.

20 Claims, 11 Drawing Figures

METHOD OF MANUFACTURING THIN-FILM FIELD-EMISSION ELECTRON SOURCE

BACKGROUND OF THE INVENTION

1. Field of the Invention

The present invention relates to a method of manufacturing a thin-film field-emission electron source and, more particularly, to a method of manufacturing a thin-film field-emission electron source having a tip portion of an electron emitting area which employs evaporation and photoetching.

2. Brief Description of the Prior Art

In general, a prior-art field-emission electron source is used in a construction in which a substance to emit electrons is formed into a sharp needle-like shape and is made a cathode, while an electrode plate for acceleration is provided on the outside, so as to concentrate the electric field on the tip of the needle.

As the material of the needle-shaped cathode, a single crystal or polycrystal of tungsten is mainly used. Recently, borides such as $LaB_6$ have also come into use.

Such a field-emission electron source, however, has the disadvantages of (1) the necessity of a superhigh vacuum (about $10^{-10}$ Torr), (2) the necessity for a high voltage power source (several tens kV) and (3) instability in the emission current. Therefore, field emission is not widely applied as compared with the thermionic emission etc.

As a field-emission electron source free from the disadvantages, there has recently been proposed a thin-film field-emission electron source which has a sandwich structure of a substrate-metallic film-insulating film-metallic film and which has a minute cavity and a field-emitting cone within the minute cavity. Such a thin-film field-emission electron source operates at a low voltage. Since the emission source is well shielded and the concentrated electric field part is confined within the cavity, its stability increases. It is also considered that the degree of vacuum may be lower than in the prior art.

Regarding the manufacture of such a thin-film electron source in which the emitter and the accelerating anode are thin films, two methods to be explained hereunder are known.

The first method includes the step of evaporating, on a substrate of sapphire or the like, three layered films of metal - insulator - metal such as Mo - $Al_2O_3$ - Mo. A minute cavity penetrating through the second and third layers is formed by a suitable mask evaporation process and/or etching process. In order to make a cathode with a tip in the cavity, two materials are respectively evaporated by oblique evaporation and normal evaporation. As the opening of the cavity gradually closes by oblique evaporation, the tip portion to be the emitter is created within the cavity by normal evaporation. Finally, only the material deposited by oblique evaporation is selectively dissolved and removed. Thus, an electron source is constructed.

The second method resembles the first method, but it differs in the manner of producing the tip portion. By utilizing the action of the first layer material or an additive material thinly covered on the first layer beforehand, the tip portion is precipitated or crystal-grown within the cavity by heat treatment. Although the theory underlying the method is partially unsolved in principle and is not clear, it can be employed on some types of materials. The method has the merit that a plurality of tip portions can also be formed within the cavity.

In the above two methods, the second has the greatest difficulty in that the most excellent material for the electron source with which electric fields are concentrated cannot be freely selected and used for the material of the tip portion. The materials which have been proven to be capable of forming the tip portion are of a small number.

On the other hand, the first method is not subject to the foregoing restriction concerning the material of the tip portion as in the second method, and hence, it can be said to be excellent. It has, accordingly, been considered that this method is an excellent manufacturing method for a known thin-film field-emission electron source.

In this method, however, the simultaneous evaporations of normal evaporation and oblique evaporation employed for constructing the tip portion within the cavity require an extremely high degree of precision in the method of manufacturing thin films. In particular, the necessity for the precise control of both the evaporations creates difficulty in the manufacture.

The enhancement of the manufactural yield in the first method is, therefore, subject to limitations. Where it is intended to distribute a large number of electron sources in a large area, manufacture is extremely difficult, even if possible in principle.

SUMMARY OF THE INVENTION

An object of the present invention is to eliminate the manufacturing difficulties in the prior art and, specifically, to provide a method of easily manufacturing a thin-film field-emission electron source by the combination between a conventional evaporating technique for forming a thin film and etching techniques.

In order to accomplish this object, the method of manufacturing a thin-film field-emission electron source according to the present invention comprises the various steps mentioned below. (i) A first layer film having a predetermined pattern which become cathodes and cathode wirings and which is made of an electric conductor is formed on a substrate by a well-known evaporation process, an evaporation process as well as a photoetching process, or a mask evaporation process. (ii) A second layer film of predetermined thickness which is made of an electron emissive material for use as emitters is evaporated on the entire surface of the substrate with the step (i) completed. (iii) Photoresist or electron beam-resist of a shape in which an expansion is imparted to a predetermined shape of each emitter tip portion (for example, a circle or square where the shape of the emitter tip portion is a point, and rectangle where the shape of the emitter tip portion is a straight line) is formed on the second layer film, so that at least its part may lie over the first layer film pattern for the cathode when it is viewed in the normal direction. (iv) Using a mesa etching process, the second layer film is etched from each opening portion of the resist pattern to the extent that the second layer film is sharpened in the vicinity of the middle lower part of the resist pattern and that a flat portion is partially left at the part. (v) The resist is removed, (iv) On the entire surface of the substrate with the step (v) completed, a third layer film which is made of an electrically insulating material for use as an electrode supporting structure member is evaporated to the extent that its entire area becomes above the height of the second layer film. (vii) The third layer film is polished to the extent that the surface of the third layer film becomes flat and that each tip portion of the second layer film is just exposed. (viii) On the third layer film with the step (vii) completed, at parts other than areas directly over the tops of the tip portions of the second layer film, a fourth layer metallic film of predetermined pattern for accelerating anode electrodes is formed by a well-known evaporation process and a photoetching process or by a mask evaporation process. (ix) Using as a mask the fourth layer film or a resist film remaining on the fourth layer film, only the third layer film is etched to the extent that the vicinities of the tops of the tip portions of the second layer film are exposed.

In general, an insulating material such as glass, ceramic and sapphire is used for the substrate material. However, where it is desired to form only a single electron source on one substrate, a good electrical conductor such as a metal may be employed for the substrate material. It is also possible to omit the step (i) by jointly using the substrate as the first layer film.

As the material of the first and fourth layer films, there is usually used any one of the elements of Mo, W, Ta, Re, Pt, Au, Ag, Al, Cu, Nb, Ni, Cr, Ti, Zr and Hf or an alloy containing at least two of the elements. The first layer film, however, may also be a semiconductor such as Si and Ge or a conductible compound such as various borides, nitrides and carbides (for example, $LaB_6$).

As the material of the second layer film, there may be used the same material as the first or fourth layer film. Also useable is a boride of a rare earth element, or a solid solution thereof. Yet, also useable is a solid solution which is composed of a boride of at least one element selected from the group consisting of rare earth elements and alkaline earth metal elements such as Ca, Sr, and Ba, and a boride of a transition metal element such as Hf and Zr. Si or Ge may also be used.

As the material of the third layer film, there may be employed an insulating material such as SiO, $SiO_2$, $Al_2O_3$, MgO, CeO, $CaF_2$ and $MgF_2$.

Where the photoetching process is used for step (viii), an etchant which does not corrode the third layer film is employed as a rule. By sufficiently controlling etching conditions, however, an etchant corroding the third layer film to some extent may be used.

As an etchant at the step (ix), one is used which corrodes neither of the materials of the second and fourth layer films and which selectively etches only the third layer film.

Regarding the polshing at the step (vii), a favorable result is sometimes obtained when, in addition to a mechanical polishing, a chemical polishing is used. Where the third layer film formed by the step (vi) does not have conspicuous protuberances near the tip portions of the second layer film and has a suitable thickness, step (vii) can sometimes be omitted.

With the method of manufacturing a thin-film field-emission electron source according to the present invention constructed as explained above, the simultaneous evaporations of oblique evaporation and normal evaporation in the prior art which involve difficulty in control become unnecessary. Any evaporation is only the normal evaporation or the entire area evaporation, and is therefore very easy. Moreover, a simple apparatus suffices.

In conformity with the manufacturing method according to the present invention, previously developed, thin-film field-emission electron sources of various shapes and uses can be very easily produced without any restriction on shape and use. Furthermore, the effect of the enhancement of precision in the manufacturing process and the effect of the reduction of the proportion defective can be brought forth.

DETAILED DESCRIPTION OF THE INVENTION

The methods of manufacturing thin-film field-emission electron sources by the prior art and according to the present invention will be described hereunder more in detail with reference to the accompanying drawings.

Figure 1:
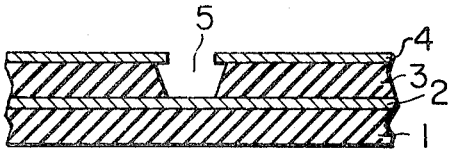
FIG. 1 (a) PRIOR ART
FIGS. 1(*a*) – 1(*d*) are sectional views showing steps in a prior-art method of manufacturing a thin-film field-emission electron source which uses both normal evaporation and oblique evaporation.
Figure 1:
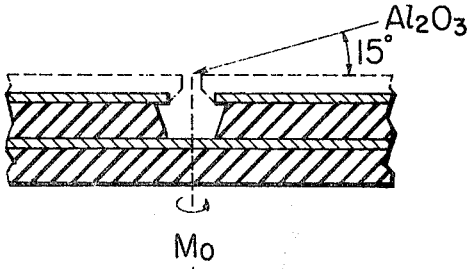
FIG. 1 (b) PRIOR ART
Figure 1:
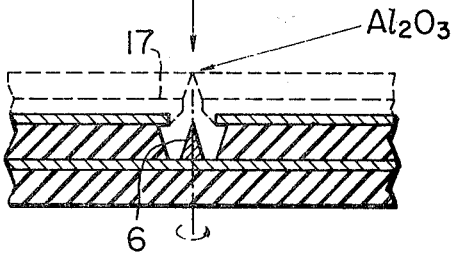
FIG. 1 (c) PRIOR ART
Figure 1:
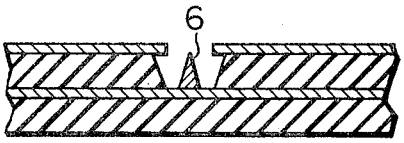
FIG. 1 (d) PRIOR ART

In the prior art, which jointly uses normal evaporation and oblique evaporation, a sandwich thin-film structure consisting of an Mo film as a cathode electrode 2, an $Al_2O_3$ film as a supporting structure film 3 and an Mo film as an accelerating electrode 4 is previously formed on a ceramic insulating substrate 1 as shown in FIG. 1 (*a*). A cavity 5 as shown in the figure is provided in the upper layer films 3 and 4. While the substrate is being rotated, simultaneous evaporations are carried out from a vaporization source of Mo which is located on the extension of a center line normal to the film surface of the sandwich structure and passing through the center of the cavity and a vaporization source of $Al_2O_3$ which is located at an angle of approximately 75° with respect to the center line. Then, the diameter of the opening portion of the cavity becomes smaller with a lapse of the evaporation time and the opening finally closes because as illustrated in FIG. 1 (*b*), the angle of incidence is so selected that vaporized molecules of $Al_2O_3$ do not impinge on a part under the opening portion of the cavity of the accelerating electrode Mo film 4. Meanwhile, an emitter 6 of a needle-shaped projection containing Mo as its main component as shown in FIG. 1 (*c*) is formed in the cavity part between the Mo film 2 of the cathode electrode and the Mo film 4 of the accelerating electrode. Subsequently, a part which adheres on the Mo film 4 of the accelerating electrode and which is made of a mixture 17 consisting of Mo and $Al_2O_3$ is chemically dissolved and removed with boiling phosphoric acid. Thus, as shown in FIG. 1 (*d*), an electron ray source of the plane cold cathode of the thin film structure can be obtained.

The foregoing prior-art method, however, has the following serious disadvantages:

1. Where the substrate is rotated about the center line coupling the vaporization source of Mo and the center of the cavity, it is difficult to locate the vaporization sources of Mo and $Al_2O_3$ and the axis of rotation for preventing $Al_2O_3$ from being mixed into the needle-shaped emitter of Mo.

2. Where the mixture consisting of alumina ($Al_2O_3$) and Mo adhering to the Mo film of the accelerating electrode at the simultaneous evaporations is dissolved and removed with the boiling phosphoric acid, the disolving and removal of the alumina rich in Mo is comparatively difficult.

3. It is difficult to produce a plane cold cathode having a large area.

With such a manufacturing method, it is extremely difficult to mass-produce thin-film field-emission electron sources.

Figure 2:
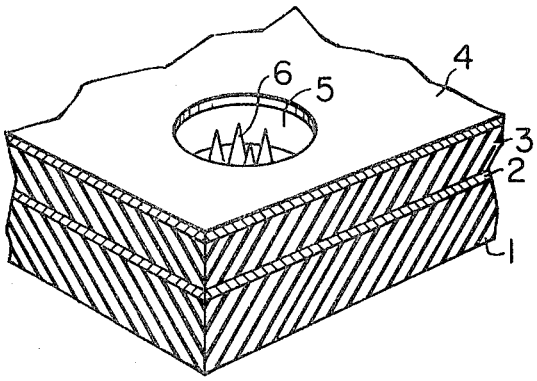
FIG. 2 PRIOR ART
FIG. 2 is a perspective view of a thin-film field-emission electron source produced by a prior-art manufacturing method in which emitters are formed by heat treatment.
Figure 3A:
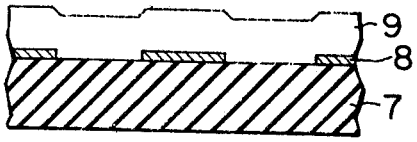
FIGS. 3(*a*) – 3 (*f*) are sectional views showing steps in a method of manufacturing a thin-film field-emission electron source according to the present invention.
Figure 3B:
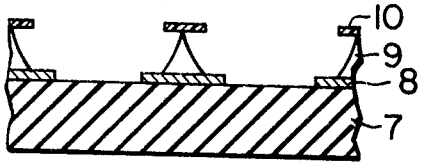
Figure 3C:
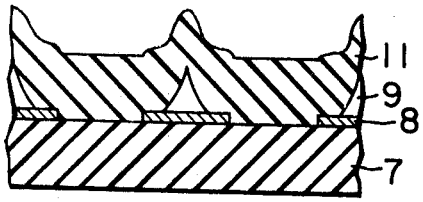
Figure 3D:
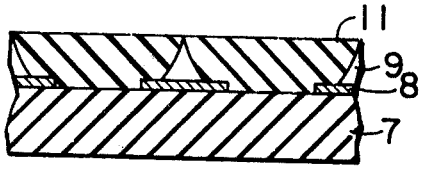
Figure 3E:
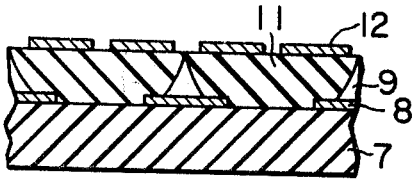
Figure 3F:
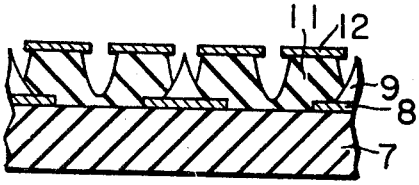

On the other hand, with the prior art in which a material of comparatively low melting point such as Al is deposited on the sandwich thin film structure shown in FIG. 1 (*a*) and, thereafter, a needle-like emitter is grown within the cavity 5 by heat treatment, a thin-film field-emission electron source as shown in FIG. 2 is obtained. The greatest difficulty of this manufacturing method is, as already set forth, that a material of excellent electron emissivity cannot be freely selected for the emitter.

The steps of the method of manufacturing a thin-film field-emission electron source according to the present invention will now be explained with reference to FIGS. 3 (*a*) – 3 (*f*).

First of all, a first-layer metallic film 8 is evaporated on a substrate 7 (of, for example, glass, ceramic or sapphire). Since the film 8 is to be used as cathodes or a cathode wiring pattern, it may be a good electrical conductor, and it may also be a semiconductor or any other suitable compound. In such a case where a plurality of electron sources are formed and the respective electron sources are used independently, the film 8 must form a pattern. In this case, the evaporation is a mask evaporation, or the pattern is formed by photoetching techniques after evaporation.

Subsequently, a second-layer film 9 is evaporated over the entire area. FIG. 3 (*a*) shows this state. Since the film 9 is worked into tip portions and constitutes the principal part of each electron source, an electron emissive material is used for the film 9.

Next, a resist film 10 (of photoresist or electron beam resist) is applied, exposed to light and developed.

In conformity with the shape of each tip portion to be formed, the resist film 10 remaining has a pattern with a width imparted to a point or line, that is, a circular, square or rectangular pattern. This pattern and the wiring pattern of the film 8 must overlap at least partially when viewed in a direction normal to the films. Otherwise, the tip portion may not be connected with the cathode. Only the film 9 is subjected to mesa etching through the resist film 10, and the etching stops when the film 9 is shaped sharply at its tip portions. This state is shown in FIG. 3 (*b*).

Subsequently, as shown in FIG. 3 (*c*), the resist film 10 is removed, and a third layer film 11 is evaporated over the entire area. A material for the third layer film 11 must be an electric insulator. The thickness of the film 11 is made sufficiently large, so as to prevent the bottom part of each dent from becoming lower than the extremity of the tip portion 9. Otherwise, inferior insulation may result. The film 11 may be formed by sputtering or vapor growth, not by evaporation. The film 11 has a protuberance in the vicinity of each tip portion 9, which protuberance interferes with subsequent steps. It is, therefore, polished and flattened as shown in FIG. 3 (*d*). The polishing is stopped immediately before the tip portion 9 is exposed.

Where the protuberance in the vicinity of the tip portion 9 is not conspicuous and the thickness of the film 11 is suitable, the polishing step can be sometimes omitted. As is well known, the polishing is well finished in some cases when a chemical polishing is used in addition to a mechanical polishing. Subsequently, a fourth layer film 12 is evaporated. Since the film 12 is used for an accelerating anode of each electron source, a good electrical conductor is employed therefor. Further, the film 12 is etched by the photoetching process so that, as illustrated in FIG. 3 (*e*), the vicinity of the top of the tip portion 9 may be removed. At this stage, the third layer film exposed between the respectively adjacent accelerating electrodes 12 may be underetched at the same time. At this time, at etchant which does not corrode the film 11 may be employed.

However, if the control of etching conditions is satisfactorily made, even at etchant corroding the film to some extent can be used. It is also possible that, by mask-evaporating the film 12, the pattern is formed without carrying out the etching.

Subsequently, using an etching which corrodes neither of the materials of the film 12 and the tip portion 9 and which selectively etches only the film 11, the film 11 is etched to a slightly overetched extent, to expose the tip portion 9. Thus, a thin-film field-emission electron source shown in FIG. 3 (*f*) is completed.

In this manner, according to the method of the invention, all the evaporations can employ a one-source evaporation. Therefore, the evaporations are not extremely easy, but also can be effected with a simple apparatus. It is a matter of course that a plurality of vaporization sources may be used in order to employ a film material of a poly-element system. As is apparent from the above explanation, mask evaporation is sometimes applicable because, although it cannot attain sufficient precision as compared with the etching technique, it can simplify the stages of manufacture. Lastly, regarding the step of the polishing the thin film, a variety of known methods may be applied.

The thin film field-emission electron sources which can be produced by the manufacturing method according to the present invention, include the following:

i. A single point electron source which has a rectangular, square or circular opening portion and in which the top of the tip portion of the second layer film is dot-like.

ii. A single line electron source which has an opening portion of a rectangle or the like shape and in which the top of the tip portion of the second layer film is linear.

iii. A composite electron source in which a plurality of point electron sources or line electron sources are arrayed so as to be regularly or irregularly distributed.

iv. In the composite electron source, a composite electron source in which wirings are so made that the respective electron sources can be independently driven by independently applying fields to the respective emitters.

v. In the composite electron source capable of the independent drive, a composite electron source of long life in which at least one emitter is used as the first electron source and another emitter is made a spare electron source for exchange.

vi. A plane electron source in which a number of point electron sources or line electron sources are arranged in an array.

vii. An electron source for panel display or for pattern display in which a number of point electron sources or line electron sources capable of the independent drive are arrayed.

viii. A composite electron source in which a number of line electron sources are arrayed in parallel, said each line electron source being so constructed that the top of the tip portion of the second layer film is rectilinear.

ix. An electron source for display adapted to emit electrons in a curved manner, in which the top of the tip portion of the second layer film is curvilinear and which has an opening portion corresponding thereto.

DESCRIPTION OF A PRESENTLY PREFERRED EMBODIMENT

Hereunder will be described a concrete embodiment of the method of manufacturing a thin-film field-emission electron source according to the present invention.

A sapphire plate 1 mm thick was used as a substrate. Mo was evaporated thereon to a thickness of about 0.2$\mu$m at a substrate temperature of approximately 500°C by an electron beam, and was made a first-layer cathode film. Subsequently, by making the substrate temperature 800°C for employing a sintered compact of an intermetallic compound $LaB_6$ as a raw material, a second layer $LaB_6$ film having a thickness of 2$\mu$m was deposited by electron beam evaporation.

Using an aqueous solution of nitric acid as an etchant and by a photoresist process, etching was carried out so that single electron source-projections whose tips were dot-like could be formed at intervals of 5 mm. $Al_2O_3$ was evaporated to a thickness 2.5 – 3 $\mu$m at a substrate temperature of 500°C again by the electron beam evaporation. The surface of the $Al_2O_3$ film was lightly polished by, for example, lapping with a diamond paste, and was flattened. Further, Mo was evaporated to 0.2$\mu$m at a substrate temperature of 500°C. Thereafter, Mo over the tip portions was etched by the use of the aqueous solution of nitric acid, to form an accelerating electrode film. Next, the $Al_2O_3$ film was dissolved with a heated solution of phosphoric acid, to expose the tip portions. Further, scribing was performed so that the electron sources might be substantially centered, and the substrate was divided into the individual electron sources. Finally, the entire structure was subjected to a heat treatment of 1000°C at 30 minutes in a vacuum furnace. Thus, the thin film point electron source of $LaB_6$ was completed.

The electron source was mounted on the part of a filament for an electron microscope. With a voltage of 220V applied between the accelerating electrode and the cathode, the electronic current was measured. Then, an emission current of 100$\mu$A was obtained. When the source was operated continuously for 100 hours under this state, no change was noted in characteristics. The emission current was sufficinently stable, the brightness of an image was found to be several times higher than in the case of a prior-art thermal filament, and the resolution was enhanced. When the tip portion was observed by a scanning electron microscope, it was revealed to have a curvature of approximately 0.1$\mu$m.

As understood also from this embodiment, the thin film field-emission electron source has many merits such as an increase brightness, reducing the size, lowering the supply voltage and making the life long.

Especially, it does not require heating unlike a thermionic source, and is therefore suitable to uses of quick response as an electron source of instantaneous lighting.

We claim:

1. A method of manufacturing a thin-film field-emission electron source, comprising the steps of:

a. selectively forming a first layer of electrically conductive material on the surface of a substrate;

b. forming a second layer of electron emissive material over the entire surface of said substrate and said selectively formed first layer;

c. selectively removing prescribed portions of said second layer of material, so as to leave at least one emitter tip portion of electron emissive material having a prescribed shape on said first layer;

d. replacing prescribed portions of said second layer removed in step (c) with a third layer of electrically insulating material;

e. selectively removing a predetermined portion of said third layer around said at least one emitter tip portion to expose at least a portion of said at least one emitter tip portion; and f. selectively forming a fourth layer of electrically conductive material on the surface of said third layer at locations other than the area directly overlying the top of said at least one emitter tip portion to porvide an accelerating anode layer on said third layer.

2. A method according to claim 1, wherein step (c) includes the steps of c1. selectively forming an etchant masking layer on said second layer, so as to overlie the selectively formed first layer, and c2. etching said second layer through said etchant masking layer until a sufficient amount of said second layer on said first layer and beneath said masking layer has been removed to leave at least one substantially sharp projecting emitter tip portion of electron emissive material directly beneath said masking layer.

3. A method according to claim 2, wherein step (d) includes the steps of d1. removing said masking layer, d2. depositing a third layer of electrically insulating material to cover said substrate, first and second layers, and d3. polishing said third layer to the extent that the surface thereof is substantially flat and has a thickness slightly greater than the height of said at least one emitter tip portion.

4. A method according to claim 3, wherein step (f) comprises selectively forming a fourth layer of electrically conductive material on said third layer resulting from step (d3), so as to leave portions thereof overlying said at least one emitter tip portion exposed, and step (e) comprises etching said third layer with said fourth layer acting as a mask, to effect the selective removal of said predetermined portion of said thrid layer around said at least one emitter tip portion, subsequent to step (f).

5. A method according to claim 4, wherein said fourth layer is so formed as to leave portions thereof spaced apart from said at least one emitter tip portion exposed, whereby additional portions of said third layer are etched in step (e), and further comprising the step of g. scribing said third layer and said substrate through the additional etched portions of said third layer, to effect the formation of an individual thin-film field-emission electron source.

6. A method according to claim 1, wherein said substrate is made of electrically conductive material and said first layer and said substrate are integrally formed.

7. A method according to claim 1, wherein said substrate is made of an electrically insulating material.

8. A method according to claim 1, wherein said substrate is made of a material selected from the group consisting of glass, ceramic and sapphire.

9. A method according to claim 1, wherein said first layer is made of at least one element selected from the group consisting of Mo, W, Ta, Re, Pt, Au, Ag, Al, Cu, Nb, Ni, Cr, Ti, Zr, and Hf.

10. A method according to claim 1, wherein said first layer is made of a material selected from the group consisting of a semiconductor and an electrically conductive compound.

11. A method according to claim 1, wherein said second layer is made of at least one element selected from the group consisting of Mo, W, Ta, Re, Pt, Au, Ag, Al, Cu, Nb, Ni, Cr, Ti, Zr and Hf.

12. A method according to claim 1, wherein said second layer is made of at least one compound selected from the group consisting of the rare earth borides.

13. A method according to claim 1, wherein said second layer is made of a solid solution of a boride of at least one element selected from the group consisting of rare earth elements and alkaline earth metal elements, and a boride of a transition metal element.

14. A method according to claim 1, wherein said second layer is made of an element selected from the group consisting of Si and Ge.

15. A method according to claim 1, wherein said third layer is made of a material selected from the group consisting of SiO, $SiO_2$, $Al_2O_3$, MgO, CeO, $CaF_2$, and $MgF_2$.

16. A method according to claim 1, wherein said fourth layer is made of at least one element selected from the group consisting of Mo, W, Ta, Re, Pt, Au, Ag, Al, Cu, Nb, Ni, Cr, Ti, Zr and Hf.

17. A method according to claim 1, wherein prescribed portions of said second layer are selectively removed in step (c) so that the tip of said at least one emitter tip portion is a sharp projection.

18. A method according to claim 17, wherein said first layer and said fourth layer are respectively formed from an electrically conductive material composed of at least one element selected from the group consisting of Mo, W, Ta, Re, Pt, Au, Ag, Al, Cu, Nb, Ni, Cr, Ti, Zr and Hf; wherein said second layer is formed from an electron emissive material composed of a member selected from the group consisting of the rare earth borides and solid solutions thereof; and wherein said third layer is formed from an electrically insulating material composed of a compound selected from the group consisting of SiO, $SiO_2$, $Al_2O_3$, MgO, CeO, $CaF_2$ and $MgF_2$.

19. A method according to claim 17, wherein said first layer is formed from (1) an element selected from the group consisting of Mo, W, Ta, Re, Pt, Au, Ag, Al, Cu, Nb, Ni, Cr, Ti, Zr and Hf, (2) an alloy containing at least two elements selected from the group consisting of Mo, W, Ta, Re, Pt, Au, Ag, Al, Cu, Nb, Ni, Cr, Ti, Zr and Hf, (3) a semiconductor material selected from the group consisting of Si and Ge, or (4) a conductible boride, nitride or carbide.

20. A method according to claim 1, wherein said first layer and said fourth layer are respectively formed from an electrically conductive material composed of at least one element selected from the group consisting of Mo, W, Ta, Re, Pt, Au, Ag, Al, Cu, Nb, Ni, Cr, Ti, Zr and Hf; wherein said second layer is formed from an electron emissive material composed of a member selected from the group consisting of the rare earth borides and solid solutions thereof; and wherein said third layer is formed from an electrically insulating material composed of a compound selected from the group of SiO, $SiO_2$, $Al_2O_3$, MgO, CeO, $CaF_2$ and $MgF_2$.

* * * * *